United States Patent [19]

Sangster

[11] 4,176,994

[45] Dec. 4, 1979

[54] COKE OVEN CHARGING APPARATUS

[75] Inventor: William H. Sangster, Collinsville, Ill.

[73] Assignee: National Steel Corporation, Pittsburgh, Pa.

[21] Appl. No.: 873,365

[22] Filed: Jan. 30, 1978

[51] Int. Cl.[2] ..... B66C 17/08; C10B 31/04

[52] U.S. Cl. ..... 414/163; 193/30; 202/262; 202/269

[58] Field of Search ..... 202/262, 254, 263, 269; 214/18 PH, 35 R; 193/30

[56] References Cited

U.S. PATENT DOCUMENTS

| | | | |
|---|---|---|---|
| 3,160,573 | 12/1964 | Nepomniashtshy | 214/18 PH |
| 3,576,263 | 4/1971 | Abendroth | 214/35 R |
| 3,628,676 | 12/1971 | Tucker | 214/35 R |
| 3,764,026 | 10/1973 | Olah | 214/35 R |
| 3,855,073 | 12/1974 | Kucharzyk | 214/18 PH X |
| 3,958,700 | 5/1976 | Foy et al. | 214/18 PH X |
| 4,004,702 | 1/1977 | Szendroi | 202/262 X |
| 4,066,175 | 1/1978 | Schulte | 202/262 X |

FOREIGN PATENT DOCUMENTS

| | | | |
|---|---|---|---|
| 565292 | 3/1958 | Belgium | 214/18 PH |

*Primary Examiner*—Arnold Turk

*Attorney, Agent, or Firm*—Shanley, O'Neil and Baker

[57] ABSTRACT

Coke oven charging apparatus includes an improved jumper pipe and charging hole sealing mechanism for conveying charging gases from an oven being charged to an adjacent oven. A substantially gas-tight coupling is formed between the larry car charging pipes and the oven charging holes, and between the jumper pipe and a charging hole in the adjacent oven, to prevent the escape of charging gases into the atmosphere and to prevent air from being drawn into the flow of charging gases. Exclusion of air reduces the temperature in the jumper pipe by preventing combustion of the charging gases, and minimizes adverse effects on the coking process in the adjacent oven.

36 Claims, 11 Drawing Figures

110
112
91
114
116
148
150
146
82
144
142
140
80
84
78
152
76
40
120
122
126
128
134
130
10.
10.
132
124
156
154
166
166
160
164
164
168
170
158
180
180
162
172
174
176
20
34
178
36

FIG.6
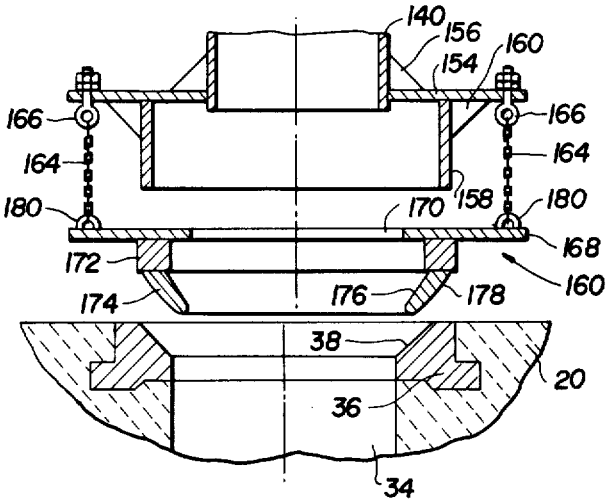
FIG.7
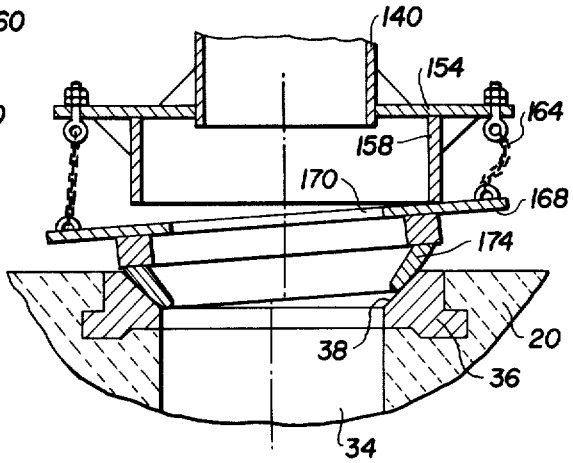
FIG.8
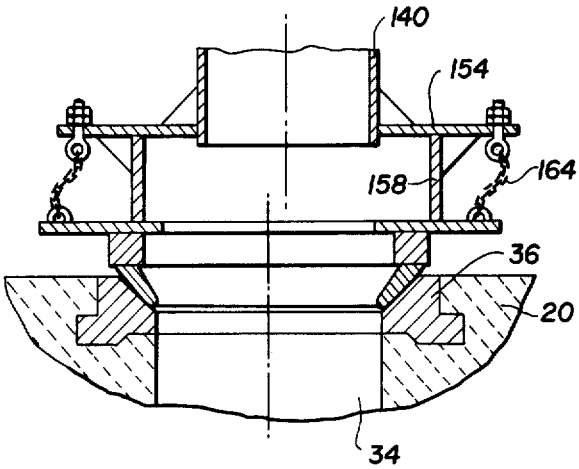
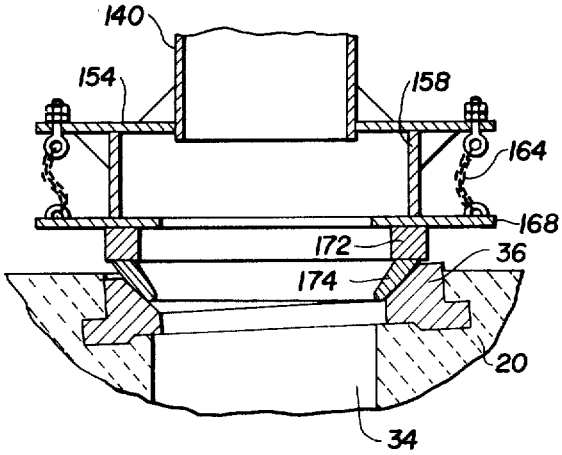
FIG.9
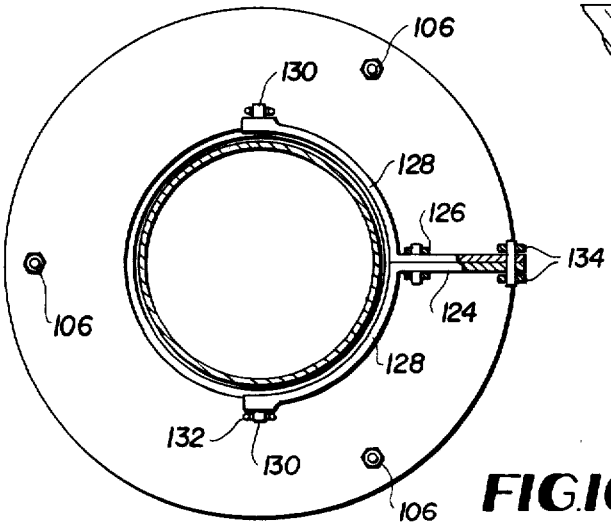
FIG.10

COKE OVEN CHARGING APPARATUS

BACKGROUND OF THE INVENTION

1. Field of the Invention

This invention relates generally to coking oven charging systems, and more particularly to a coking oven charging system employing an improved connecting means for forming a substantially gas-tight connection with a charging hole or port in the top wall of a coke oven to substantially reduce emissions during charging.

2. Description of the Prior Art

Coke ovens of the type employed in the production of metallurgical coke used, for example, in the production of iron and steel are generally of the regenerative or by-product recovery type and are constructed in batteries consisting of a number of transversely-extending coking chambers or ovens and heating flues or chambers arranged alternately along the length of the battery. The ovens and heating chambers are constructed of or lined with heat resistant refractory material and have a continuous top wall extending over the entire battery. The individual ovens are charged through a plurality of normally-closed charging holes extending through the top wall and arranged at spaced intervals along the length of the individual ovens. Coal is charged into the ovens from hoppers carried by a larry car running on rails or tracks extending along the top wall of the battery.

To charge an oven, the larry car is positioned with the coal hoppers located directly above the charging holes in the oven. The charging hole covers or lids are removed and charging pipes at the bottom of the hoppers are brought into registry with the top rim of the respective charging holes. The bottom of the hoppers are then opened, permitting finely crushed coal to flow by gravity directly into the hot coking chamber. This produces a surge of gas from the chamber due both to the displacement of the furnace gas by the large volume of coal and to the generation of additional gases by the vaporization of moisture in the coal and the initial burning and volatization of the newly-deposited coal. This surge of gas during charging is referred to herein as charging gas to distinguish from the gases normally evolved during the coking process.

Regenerative, or by-product ovens are conventionally fitted with aspiration or ascension pipes connected to a large collecting main extending the length of the battery and leading to a by-product recovery plant. During the coking cycle, the distillation products evolved in the ovens flow through the aspiration pipes and collector main to the by-product plant where they are processed for the separation of fuel gases, chemicals, solid pollutants, and the like. However, during charging of an oven, the increased gas flow can overburden the ascension pipe and the charging gases tend to flow out the charging opening around and through the descending stream of coal.

As coal is charged into an oven, it tends to pile up in cone-shaped mounds each having its peak directly beneath a charging hole. When a full charge of coke is received in an oven, these peaks are leveled off by a leveling arm which is telescoped through an opening in the oven door; however, until they are leveled, they can reach the top of the oven chamber or even extend into the charging hole, and can restrict or block the flow of the charging gases over the top of the charge of coal to the ascension pipe at the end of the oven. The result can be a substantial build-up of pressure in pockets at the top of the charge and an increased tendency of the charging gases to flow out of the oven through the charging holes.

In addition to the unburned and partially burned volatiles in the charging gas, substantial quantities of finely comminuted coal particles and dust can be entrained in and carried back out of the oven. In the past, this mixture of gas and solid material has resulted in substantial atmospheric pollution, and various solutions to the problem have been proposed.

One solution to the charging gas emission problem has been the use of a jumper pipe carried by the larry car for connecting one or more charging holes of an oven being charged with a charging hole in an adjacent oven in which the coking process is in progress. While these devices have been effective in substantially reducing emissions, their operation has not always been entirely satisfactory or without difficulty. For example, the extreme heat encountered in the coking ovens and heating chambers can produce substantial distortion in the top wall of the battery, particularly in older ovens, making it difficult to properly align the charging pipe on all the hoppers and the jumper pipe with the charging holes in the ovens to form a gas- and air-tight flow path between the two ovens. This has resulted in the escape of emissions from the jumper pipe system into the atmosphere as well as the entrainment of atmospheric air into the gases flowing through the jumper pipe to the adjacent oven. The admission of air into the gases is highly objectionable because it promotes combustion and substantially increases the temperature in the jumper pipe. This increased temperature greatly reduces the useful life of the jumper pipe system and can affect the coking process in the adjacent or connected oven. Further, substantial quantities of air can directly affect the coking process in the adjacent oven by burning the combustible gases generated in that oven. Also, an excessive burden can be placed on the aspiration system of the adjacent oven as a result of the additional gases produced.

SUMMARY OF THE INVENTION

The present invention is concerned with methods of and apparatus for charging coke ovens while overcoming or avoiding the foregoing disadvantages of the prior art charging systems and which will substantially reduce polluting emissions and prolong the life of the charging apparatus. A corollary objective is to provide methods of and apparatus for charging coking ovens in which an improved seal is provided between the coking oven charging hole rim casting and the larry car charging pipes and jumper pipe to substantially eliminate leakage of air into the jumper pipe system and the escape of charging gases during the charging operation.

In the attainment of the foregoing and other objectives and advantages, an important feature of the invention resides in providing an improved jumper pipe system on a larry car, which jumper pipe system utilizes an improved, flexible or universal, substantially gas-tight coupling between a charging hole rim casting and the larry car charging pipe, and between the jumper pipe and a charging hole rim casting on an adjacent oven. The improved seal readily adapts to limited distortion or misalignment of the charging hole rim casting thereby reducing the accuracy requirement in positioning the larry car and simplifying the procedure for establishing the coupling between the seal and charging hole rim casting. This can substantially reduce the length of time that the charging hole is open to atmosphere at the beginning and termination of the charging procedure.

The reduction of free air in the charging gases flowing from the oven being charged through the jumper pipe system to the adjacent oven substantially reduces the burning of gas in the jumper pipe and thereby avoids excess heating of the jumper pipe system. Further, elimination or reduction of air in the jumper pipe system avoids the well-known adverse effects of excess air on the coking process in the adjacent coking oven.

BRIEF DESCRIPTION OF THE DRAWINGS

The foregoing objects and features of the invention will become more apparent from the detailed description contained hereinbelow, taken in conjunction with the accompanying drawings, in which:

FIG. 6 is a fragmentary sectional view of a portion of the structure of FIG. 3 and showing the seal slightly misaligned with respect to the coke oven charging hole;

FIG. 7 is a view similar to FIG. 6 and illustrating the jumper pipe and seal being positioned over the charging hole;

FIG. 8 is a view of the structure shown in FIGS. 6 and 7 and showing the jumper pipe and seal in position forming a gas-tight seal with the charging hole;

FIG. 9 is a view similar to FIG. 8 and showing the seal formed with a charging hole rim casting which is disposed at an angle with respect to the horizontal;

FIG. 10 is a sectional view taken on line 10—10 of FIG. 5; and

DESCRIPTION OF THE PREFERRED EMBODIMENT

Figure 1:
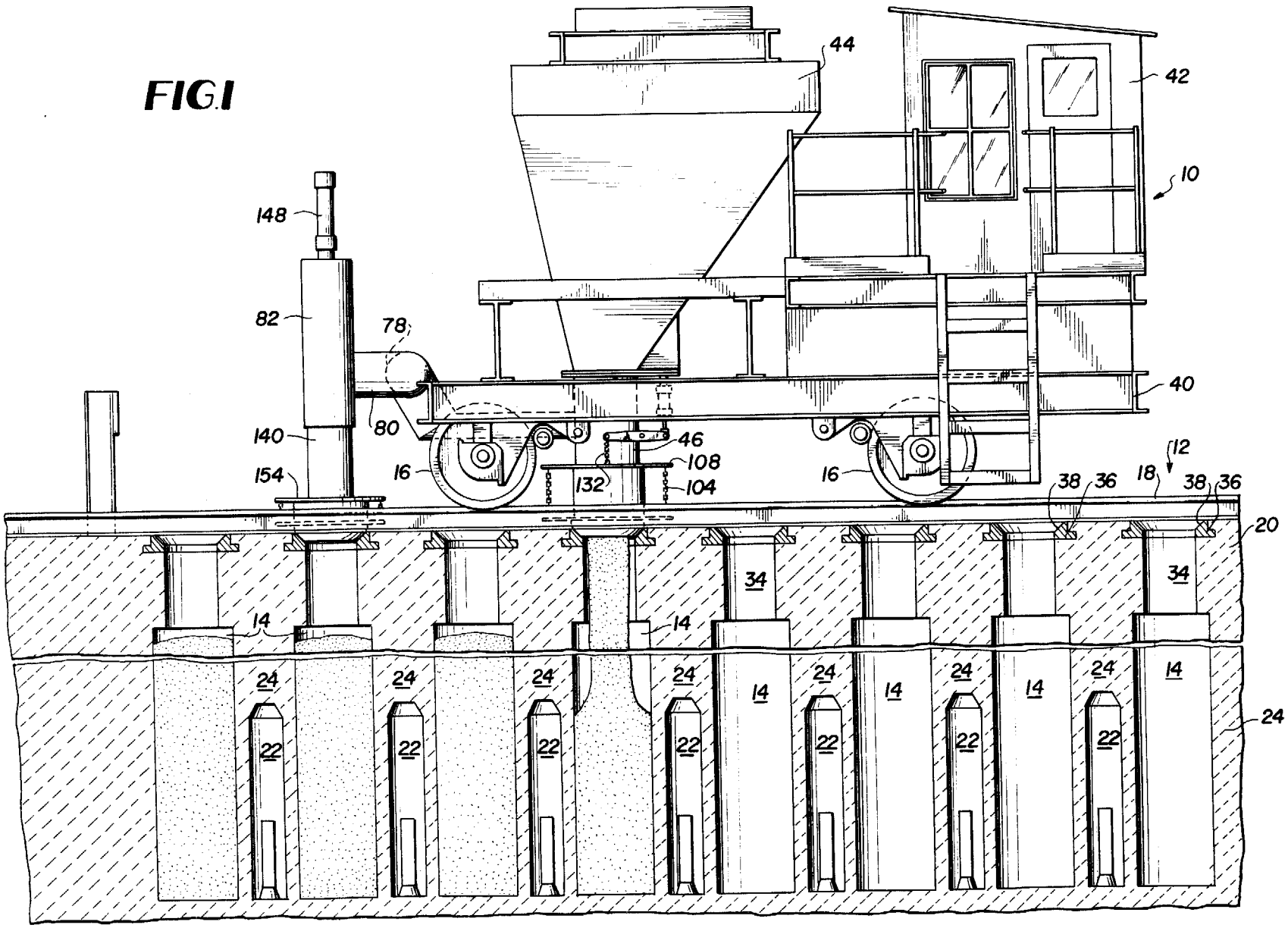
FIG. 1 is a fragmentary elevation view, partially in section, showing a battery of by-product coking ovens having a larry car embodying the invention in position to charge an oven in the battery.
Figure 11:
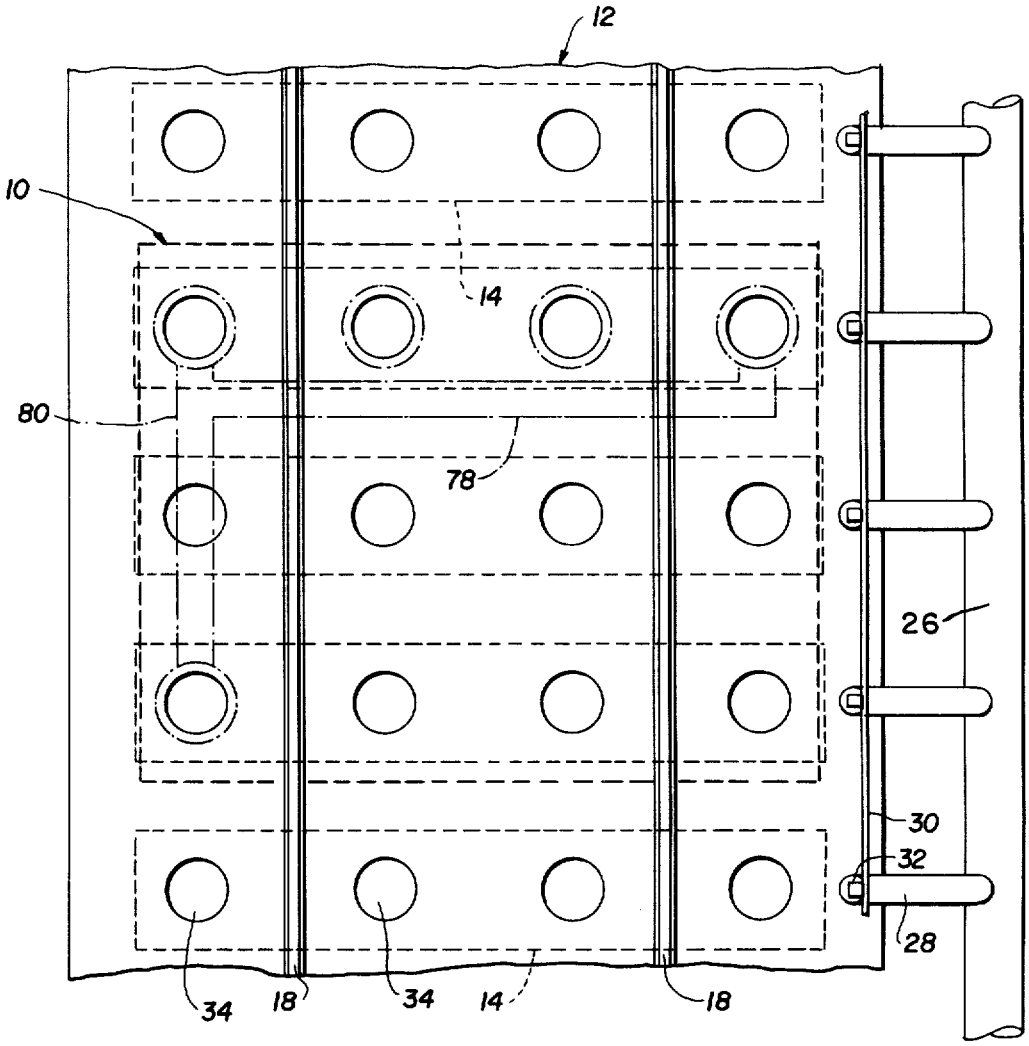
FIG. 11 is a top plan view of a portion of the battery of coke ovens and showing the larry car in position thereon in phantom.

Referring now to the drawings in detail, a coke oven charging apparatus embodying the present invention is designated generally by the reference numeral 10 in FIG. 1 and shown in position on a battery 12 of by-product coke ovens 14. The larry car 10 is supported by wheels 16 which roll on rails 18 extending along the top wall 20 of the battery of ovens 12. The individual ovens 14 extend transversely of the length of the battery and are arranged in alternate relation with heating flues 22 formed in the refractory walls 24 separating the ovens. A large collecting main, or pipe 26 extends the length of the battery above and adjacent one end of the respective ovens, and an aspiration pipe 28 connects the end portion of the top of each oven to the collecting main as shown in FIG. 11. Steam may be supplied through a conduit 30 and inlet nozzle structure 32 for injecting steam into the aspiration pipe in the direction of the collecting main to assist in drawing gases, by an aspiration effect, from the interior of the oven to the collecting main during the coking process. Collecting main 26 leads to the conventional by-product plant, not shown, where the gases are processed in the conventional manner.

As shown in FIG. 11, a plurality of charging holes 34 are formed in and extend through the top wall 20 in communication with each of the ovens 14. The charging holes 34 are spaced from one another to permit coal to be deposited into the oven at spaced intervals along its length. The charging holes are preferably circular in horizontal cross-section and have a diameter which is only slightly less than the width of the coking chamber. The charging holes have their top rims formed by an annular metal ring or casting 36 which is rigidly retained in position by the refractory material of the top wall 20. The central opening of casting 36 flares outwardly at the top of the charging hole, presenting a conical sealing surface 38 which, during the coking operation, supports a generally spherical mating surface on a heavy charging hole cover, not shown.

Figure 2:
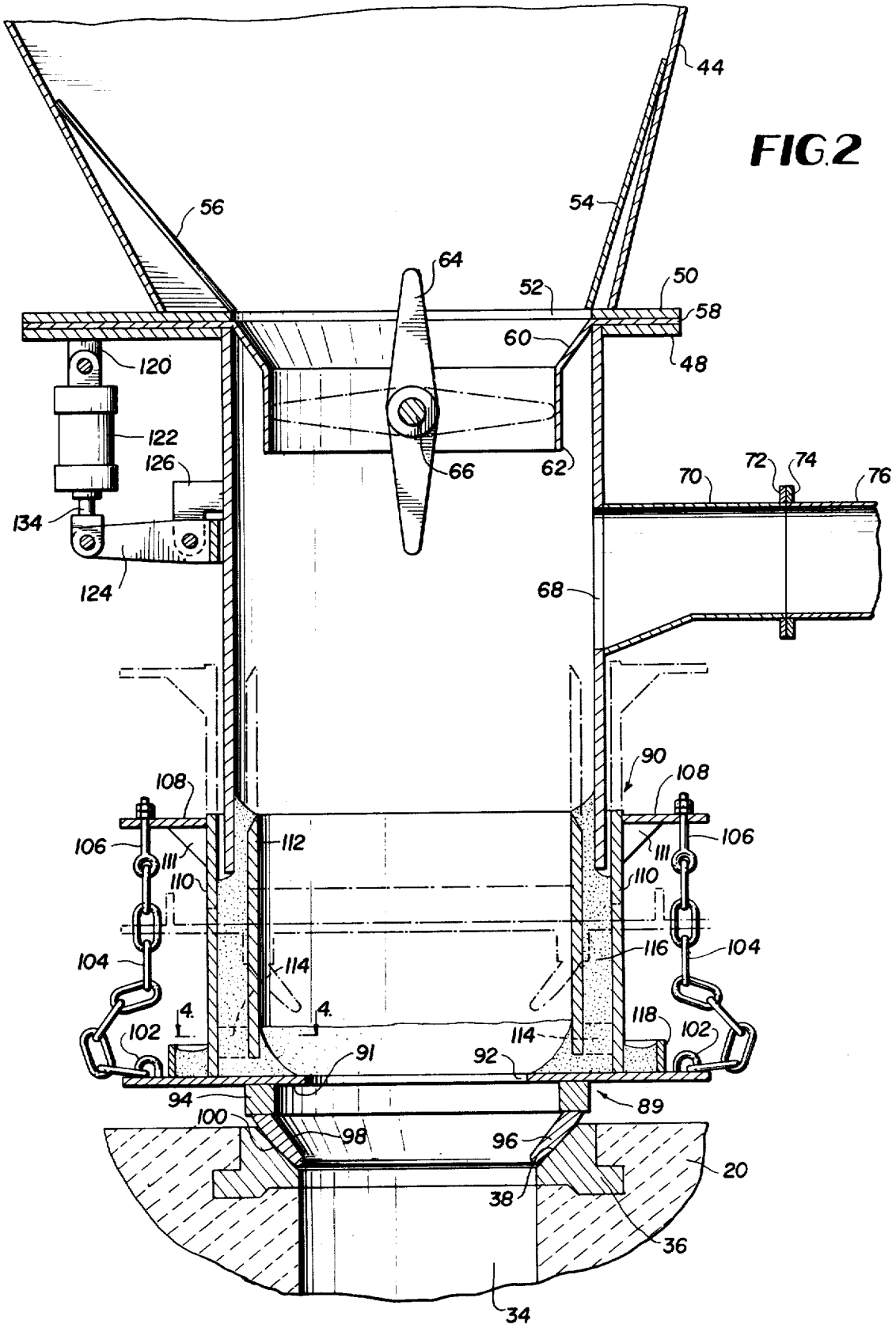
FIG. 2 is an enlarged fragmentary sectional view, in elevation, of a portion of the larry car and oven structure of FIG. 1 and showing the charging pipe and seal on the bottom of a coal hopper.

As seen in FIG. 1, the larry car 10 includes a rigid frame structure 40 mounted on the wheels 16 and supporting a suitable drive system, not shown, for propelling the car along the tracks 18 in response to controls in the operator's booth 42. A plurality of coal hoppers 44 are supported on the frame, with the individual hoppers 44 being aligned transversely of the larry car in position to be located with their respective discharge outlets one directly above each of the charging holes 34 of an oven to be charged. Each hopper 44 is fitted, at its bottom end, with a fixed, downwardly-extending charging pipe 46 which, as best seen in FIG. 2, has a diameter substantially greater than the diameter of the charging hole 34. Each charging pipe 46 has a radially-extending top flange 48 connected, as by bolts, not shown, to a flange 50 rigidly joined, as by welding, to the bottom of the inclined outer wall of the hopper 44. Flange 50 has a central opening 52 preferably of a diameter generally corresponding to the internal diameter of the charging pipe 46, and rigid baffle plates 54, 56 fitted within the bottom portion of the hopper 44 act to guide, or funnel, coal from the hopper through the opening 52.

The flow of coal from the respective hoppers 44 is controlled by a valve assembly including a radially-extending flange 58 mounted between flanges 48 and 50, a downwardly and inwardly inclined, substantially conical section 60 and a vertically-extending cylindrical guide pipe section 62 spaced radially inward from and arranged coaxially with the charging pipe 46. A butterfly valve disc 64 mounted on a horizontally-extending shaft 66 is supported within the cylindrical guide pipe section 62 for movement between an open position shown in full line and a closed position shown in phantom in FIG. 2. Suitable actuating means such as a crank arm and pneumatic cylinder, not shown, are provided for rotating the valve between the open and closed position. The valve disc 64 is dimensioned to fit snugly within the interior of the guide tube section 62, when in the closed position, to effectively form a gas seal, preventing the flow of gas upwardly through the charging pipe and hopper as well as preventing the flow of coal from the hopper when the valve is in the closed position. However, to assure a more positive seal, the valve is preferably closed while a small quantity of coal remains in the hopper to act as a secondary seal. When in the open position, the valve 64 permits coal to flow from the hopper in a substantially cylindrical stream which is smaller in diameter than the interior of the charging pipe 46.

The charging pipes 46 on at least the end-most hoppers 44 of the larry car are provided with an opening 68 in their side wall, in the upper region thereof, and a horizontally-extending conduit section 70 is rigidly welded to the charging pipe in communication with the opening 68. The conduit section 70 has a flange 72 mounted thereon for coupling to a mating flange 74 of a pipe 76 which, in turn, is joined to a manifold 78 of a jumper pipe system carried on the larry car.

Figures 3, 4, 5:
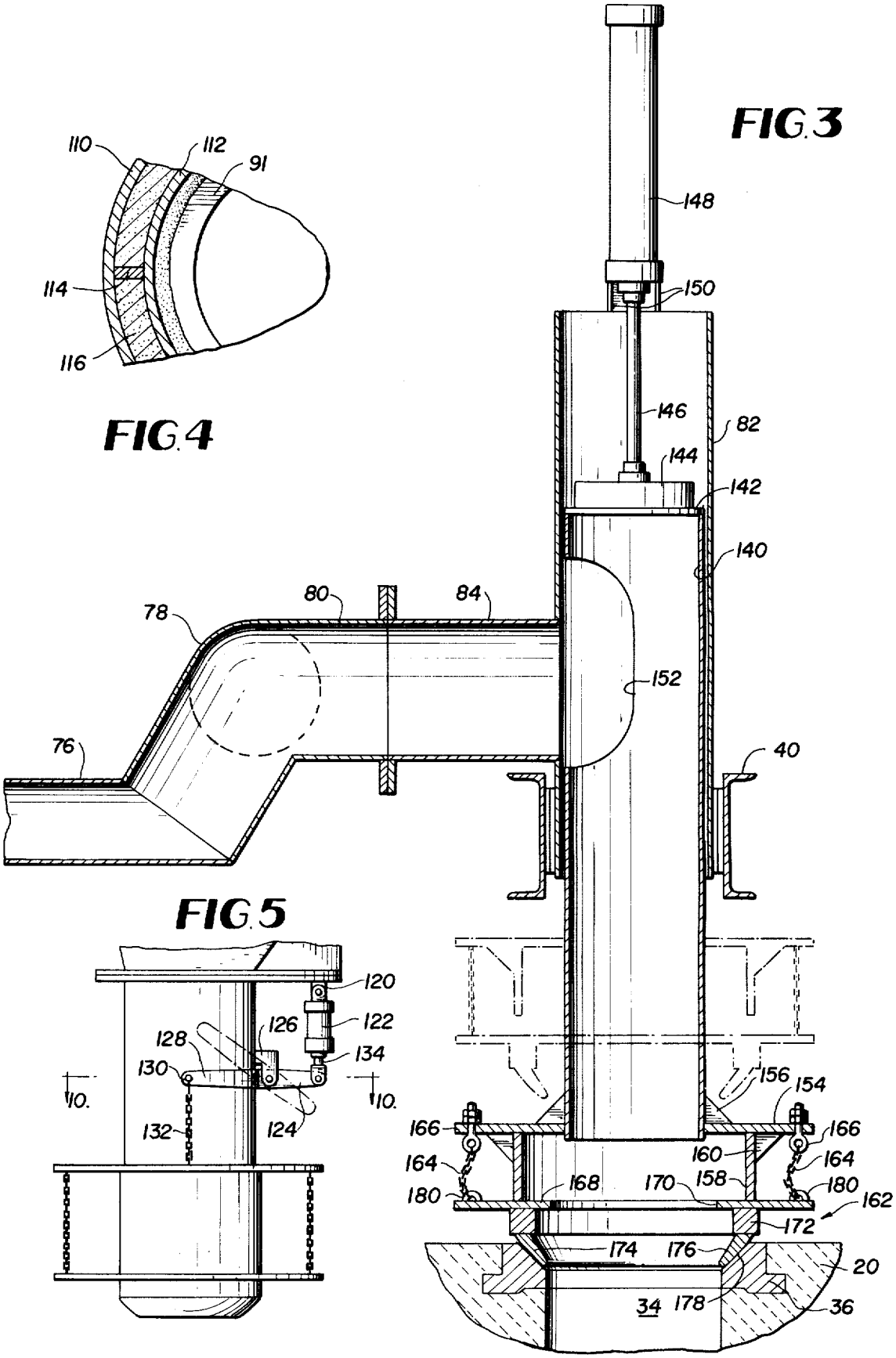
FIG. 3 is an enlarged fragmentary view of another portion of the larry car and showing portions of the jumper pipe seal arrangement.
FIG. 4 is a fragmentary sectional view taken on line 4—4 of FIG. 2.
FIG. 5 is an elevation view of the charging pipe and seal actuating mechanism employed on the bottom of the larry car hoppers.

As best seen in FIG. 3, the manifold 78 is connected, through a rearwardly-extending flanged nipple 80, to a T-shaped pipe assembly having its through section 82 rigidly supported on the frame 40 and the perpendicularly-extending branch section 84 rigidly joined to the flanged nipple 80. Thus, fluid communication is provided from the respective conduit members 70 on the charging pipes 46 through the manifold 78 to the vertically-extending interior of the through section 82 of the pipe tee structure.

Referring again to FIG. 2, the arrangement for providing a substantially gas-tight seal between the interior of the charging pipe 46 and the rim casting 36 of the charging holes 34 includes a sealing ring assembly 89 and a concentric sleeve assembly extending below and mounted for movement along the bottom portion of charging pipe 46. Sealing ring assembly 89 includes an annular, flat plate 91 having a central circular opening 92 formed therein, with the opening 92 preferably being substantially equal to or slightly less than the diameter of the charging hole 34. An annular ring-shaped spacer member 94 having an internal diameter substantially larger than the diameter of the opening 92 is rigidly joined as by welding onto the bottom surface of the plate 91 in concentric relation with the opening 92. A sealing ring 96 having an inwardly and downwardly inclined, substantially cone-shaped inner surface 98, and an outer, downwardly and inwardly extending spherical shaped outer surface 100 is mounted on the bottom surface of the spacer ring 94. The central opening of the sealing ring 96 is substantially equal to the diameter of the charging hole 34.

The spherical surface 100 is adapted to rest upon and form a substantially line contact seal with the upwardly directed conical surface 38 of the ring 36. Thus, conical surface 38 and spherical surface 100 provide a substantially universal connection, permitting limited misalignment of the plane of the plate 91 and the plane of the top surface of the top ring 36 while maintaining a substantially gas-tight seal. A plurality of lifting eyes, or cleats 102 are welded to the top surface of the plate 91, at spaced intervals around the periphery thereof, for attaching flexible lifting members such as chains 104, to lift and lower the plate, and the sealing ring 96 supported therebeneath, into and out of sealing engagement with the charging hole top ring. While chains 104 are shown in diametrically opposed relation in FIG. 2, three such chains equally spaced around the periphery of plate 91 are preferably employed.

The chains 104 have their top end connected, as by adjustable eye bolts 106, to a radially extending flange 108 rigidly welded adjacent the top of an outer cylindrical sleeve 110 of the concentric sleeve assembly 90. Sleeve 110 is telescopingly received on and freely movable along the bottom outer surface of the charging pipe 46. Brackets 111 can be provided to reinforce flange 108. The internal diameter of the sleeve 110 is slightly larger than the external diameter of the charging pipe 46 to assure free telescoping movement of the sleeve 110 along the bottom portion of the charging pipe. The combined length of chains 104, eye bolts 106 and lifting eyes 102 is slightly greater than the length of sleeve 110, so that, when the assembly is raised from the charging position shown in full line to the storage position shown in phantom, the top of plate 91 is suspended below the bottom of the sleeve 110 by chains 104.

A second cylindrical sleeve 112 is mounted coaxially with and in inwardly-spaced relation to the sleeve 110 by a plurality of radially-extending spokes, or spacer blocks 114. The spokes 114 are rigidly welded to the outer surface of the sleeve 112 at its bottom edge, and to the inner surface of the sleeve 110 in upwardly spaced relation to its bottom end so that the bottom of the sleeve 112 is spaced vertically above the bottom of the sleeve 110. The diameter of the sleeve 112 is substantially greater than the diameter of the opening 92 in plate 91, but somewhat less than the internal diameter of the charging pipe 46. As indicated in FIG. 2, the spacing between the outside diameter of sleeve 112 and the inside diameter of the charging pipe 46 is preferably slightly greater than the spacing between the outside diameter of the charging pipe and the inside surface of the sleeve 110. This enables fine coal particles to fall into the annular space 116 between the sleeves 112 and 114 to provide an effective gas seal with the charging pipe 46. An annular ring 118 is mounted on and projects upwardly from the top surface of plate 91 to prevent coal from spilling over the edge of the plate as more fully described hereinbelow. The diameter of ring 118 is substantially larger than that of the sleeve 110.

A bracket 120 is rigidly mounted, as by welding, onto the bottom surface of the flange 48 and projects downwardly therefrom on the side of charging pipe 46 opposite to the opening 68. Bracket 120 pivotally supports one end of a fluid cylinder 122 which, in turn, has its other end pivotally connected to one end of an actuating lever assembly 124. As best seen in FIG. 10, actuating lever 124 is generally Y-shaped and is pivotally supported on the charging pipe 46 by an angle bracket 126. The actuating lever 124 includes a pair of arcuate arms 128 extending partially around the outer circumference of the charging pipe 46, with the arms 128 terminating on opposed sides of the charging pipe. A pair of pins 130 mounted one on the end of each of the arms 128 support a pair of chains 132 (see FIG. 5) which, in turn, are connected to the top surface of the flange 108 on diametrically opposed sides of the charging pipe. Thus, actuation of the fluid cylinder 122 to project the piston rod 134 will depress the outwardly projecting end of the actuating lever 124 to pivot the lever on the support bracket, causing the arms 128 to be raised. This pivotal movement of the actuating lever, acting through the chains 132, will initially raise the concentric sleeve assembly 90 while leaving the sealing ring assembly 96 in position on the charging hole casting 36. This is made possible by the excess length of the chains 104 which are in a slack, or collapsed condition when the seal assembly is in the charging position. Continued movement of the actuating lever will quickly take up this slack, causing the chains to lift the plate 91 and the seal structure supported thereon clear of the casting 36 and the top wall 20 of the oven. In this lifted condition, the bottom edge of the sleeve 110 is spaced above the top surface of plate 91 by a distance no greater and preferably slightly less than the height of the annular ring 118. This spacing of the plate 91 below the bottom of the concentric sleeve assembly permits limited free swinging movement of the plate relative to the charging pipe, and relative to the concentric sleeve assembly.

Raising of the concentric sleeve assembly 90 will cause the bottom end of the fixed charging pipe 46 to be telescoped farther into the space 116 between the concentric sleeves 110, 112. This will tend to force a limited amount of coal out the bottom of the annular space 116 beneath the bottom end of sleeve 112 onto the top surface of plate 91 so that the coal does not prevent the desired telescoping movement. During this upward movement, the annular ring 118 will prevent coal from flowing outwardly beneath the bottom end of sleeve 110 to be spilled over the peripheral edge of plate 91 onto the top wall of the ovens.

In order to establish a fluid-tight seal between a charging pipe 46 and a charging hole of an oven, the larry car is moved into position with the charging pipe positioned axially above the charging hole. The charging hole cover is removed (either before or after positioning the larry car for charging the oven) and the fluid cylinder 122 is actuated to retract the piston 134, thereby lowering the chains 132. The weight of the relatively massive steel structure of the seal assembly 89 and the concentric sleeve assembly 90 causes it to telescope downwardly along the charging pipe 46 until the spherical surface 100 of the sealing ring 96 comes into contact with the conical surface 38 of the charging hole casting 36. Thereafter, the concentric sleeve assembly will continue to move downwardly, with the chains 104 collapsing, until the bottom end of the outer sleeve 110 comes to rest on the top surface of the plate 91. The weight of the concentric sleeve assembly also levels the plate 91 automatically, causing a ball-and-socket-type movement of the spherical surface within the conical surface of the charging hole casting.

Since the coal used to charge the oven is very finely divided, the relatively thin metal of the end of the sleeve 110 readily presses substantially through any coal on the top surface of the plate. In this regard, if desired, the bottom end of the sleeve 10 can be rounded or wedge-shaped to assure substantially metal-to-metal contact with the top of the plate 91.

Since the diameter of the central opening 92 is substantially less than the diameter of the inner cylindrical sleeve 112, the coal collected in the space 116 will not freely flow out of the space when the seal assembly is in the raised position so that sufficient coal is always retained in this space to provide an effective seal with the bottom end of the charging pipe 46.

Note that the automatic leveling between the bottom plate 91 and the concentric sleeve assembly is independent of the attitude of the charging hole casting 36 so that a substantially gas-tight, line seal is provided regardless of limited skewing or misalignment of the charging hole casting. Also, since the chains 104 permit limited lateral movement of the plate 91 with respect to the concentric sleeve assembly, precise vertical alignment of the charging pipe with the axis of the charging hole is not required, so that positioning of the larry car is facilitated.

Referring now to FIG. 3, means for quickly and accurately providing a gas-tight fluid communication with an oven being charged, through the charging pipe 46 on a hopper above an oven being charged to an adjacent oven through a charging hole therein will be described in detail. This structure for establishing fluid communication between adjacent ovens is conventionally referred to as a jumper pipe and provides a flow path for charging gases to "jump" from an oven being charged into an oven in which the coking process is in progress. Thus, the jumper pipe structure of the present invention includes an elongated pipe member 140 positioned within the cylindrical bore of the vertically-extending pipe section 82. Pipe 140 has its upper end closed by an end plate 142, and a bracket 144 supported on plate 142 is connected to the rod 146 of a fluid cylinder assembly 148 supported on the top of pipe section 82 by a pair of cross arms 150. Pipe 140 has an outside diameter which is only slightly smaller than the inside diameter of pipe section 82 so as to enable the pipe 140 to be slid longitudinally within the pipe section 82. The bottom end of the pipe 140 projects downwardly beneath the members of the frame 40 supporting pipe section 82. The spacing between the axis of pipe 140 and charging pipe 46 corresponds to the spacing, along the length of the battery, between the charging holes of the ovens to be connected by the jumper pipe structure so that positioning the larry car with respect to an oven to be charged automatically positions the pipe 140 relative to a charging hole of an adjacent oven.

An opening 152 is formed in the side wall of pipe 140 in position to overlie the open entrance end of T-section 84 when the piston rod 146 is in the extended, or lowermost position, thereby establishing fluid communication through the T-section 84 into the interior of pipe 140. The length of the stroke of the fluid cylinder 148 is such that, when the piston rod 146 is in the retracted or raised position shown in phantom in FIG. 3, opening 152 is spaced above the T-section 84 so that the adjacent outer surface of pipe section 140 effectively forms a seal closing the pipe section 84.

An annular flange 154 is rigidly supported on the bottom end of pipe 140, and suitable brackets 156 may be provided to reinforce the joint between the pipe and flange. An annular sleeve 158, having a diameter substantially greater than the diameter of pipe 140, is rigidly mounted on the lower surface of flange 154 in coaxial relation with the pipe 140. Suitable reinforcing brackets 160 may be provided to reinforce the connection between the flange 154 and sleeve 158.

A seal assembly 162 is suspended beneath the bottom end of sleeve 158, when the pipe 140 is in the raised position shown in phantom in FIG. 3, by a plurality of chains 164 having their upper ends connected to the bottom surface of plate 154 as by eye bolts 166.

The seal assembly 162 is similar in construction to seal assembly 89 and includes a flat annular plate member 168 having a central opening 170 formed therein. An annular spacer ring 172 is rigidly connected, as by welding, to the bottom surface of plate 168. Ring 172 has a diameter substantially greater than the diameter of opening 170, with the ring 172 and opening 170 being in fixed concentric relation. An annular sealing ring 174 is rigidly mounted on and projects downwardly and inwardly from the bottom surface of the spacer ring 172. Sealing ring 174 has an inwardly and downwardly inclined, generally conical inner surface 176 and a downwardly and inwardly extending, substantially spherical outer surface 178 which, like sealing surface 100 of ring 96, is adapted to engage and form a substantially line contact seal with the conical surface 38 of the charging hole casting 36. Lifting eyes 180 rigidly mounted on the top surface of flange 168 are provided for attaching the lifting chains 164.

The length of chains 164, including eye bolts 166 and lifting eyes 180, is slightly greater than the axial length of the sleeve 158 so that, when the pipe 140 is in the lowered position as shown in FIG. 3, with the seal assembly 162 in position providing a seal with the charging hole of an oven, the chains 164 are slightly collapsed, or slack. In the raised position, however, the chains support the seal assembly with the top surface of the plate 168 suspended beneath the lower end of the sleeve 158 to thereby permit relative movement between the seal assembly and the sleeve 158 much in the manner as permitted between the seal assembly 89 and the concentric sleeve assembly 90 shown in FIG. 2.

FIGS. 6, 7, 8 and 9 illustrate the positioning of the sealing ring assembly 162 on the sealing surface 38 of a charging hole casting 36. FIGS. 6, 7 and 8 illustrate steps of forming a gas-tight seal when the pipe 140 is slightly mis-aligned with respect to the vertical axis of the charging hole. Thus, as the pipe 140 is lowered from the position shown in FIG. 6 to that in FIG. 7, the eccentric relationship of the sealing ring 174 and casting 36 will cause the spherical surface 178 to engage the conical surface 38 on one side before the other, thereby causing the sealing assembly to be tilted with respect to the horizontal. Further lowering of the pipe 140, and of the flange structure supported on the lower end thereof, will cause the bottom of the sleeve 158 to engage the top surface of the plate 154 and shift it to the horizontal position due to the weight of the pipe 140 and the structure supported thereon. This shifting action is permitted as a result of the line contact between the spherical surface 184 and the conical surface 38 which produces both rotary and lateral movement of the seal assembly. Thus, a substantially gas-tight seal is provided despite the axial misalignment of the pipe 140 and the charging hole 34.

FIG. 9 illustrates the relative positions of the sealing ring and the charging hole casting when the charging hole ring is skewed out of the horizontal. Thus, again it is seen that a substantially gas-tight seal is provided.

Under normal conditions, the weight of the pipe 140, flange 154, and sleeve 158 will be sufficient to produce the universal-type movement between the sealing ring and the charging hole casting to form a gas-tight seal. Thus, the fluid cylinder 148 may be a single acting cylinder, operable by the application of fluid pressure to retract the piston and a rod 146 and, upon venting the fluid pressure, to permit the weight of the supported assembly to extend the piston rod.

While the alignment of the sealing ring assembly 162 is illustrated in FIGS. 6–9, it is understood that the sealing assembly 89 would be aligned in essentially the same manner. However, since no coal will be charged into the oven through the sealing ring assembly 162, the top surface of plate 154 can be kept clean and a gas-tight, metal-to-metal seal will readily be provided between the bottom end of the sleeve 158 and the top surface of the plate 168.

The coupling structure employed to form the substantially gas-tight connection between the charging pipes and jumper pipe system and the coke oven charging holes spaced therebeneath is extremely simple in construction and essentially maintenance-free. The narrow, metal-to-metal contact area between the sealing surfaces enables a reliable seal to be maintained while relying only on the weight of the component parts to maintain the sealing contact. It is apparent, however, that in applications where lightweight structures could be employed, additional pressure could be applied, as by use of an air cylinder or the like, to firmly press the elements together and assure a good seal.

The use of a spherical sealing surface on a sealing ring to engage the top rim portion of the charging hole facilitates alignment of the sealing ring and sleeve members in that minimal frictional contact with the rim is provided. This enables the weight of the sleeve assembly to readily rotate the sealing ring assembly, in a ball-and-socket type movement on the conical surface of the charging hole casting, to provide sealing contact between the two assemblies. Further, the line contact provided by the spherical sealing surface reduces the likelihood of foreign objects becoming lodged between the rim casting and the sealing ring as can happen when conical-to-conical or planar-to-planar sealing surfaces are employed.

The use of flexible tensile members such as chains 104 and 164 to support the sealing ring assembly beneath the sleeve enables the free swinging movement of the sealing ring to accommodate limited lateral misalignment between the axis of the charging hole and the pipe positioned thereabove while, at the same time, eliminating the possibility of binding during relative vertical movement after the seal assembly engages and is supported by the charging hole rim. Other collapsible linkage means may also be provided, the only critical feature being that the linkage permit both limited lateral and vertical relative movement between the sleeve and seal assembly.

While an annular ring of finely-divided coal is illustrated as providing the seal between the sleeve assembly 90 and the charging pipe 46, and no separate sealing means is illustrated between the vertically-movable pipe member 140 and the stationary pipe section 82, various sealing means may be employed in either of these positions. For example, an O-ring seal or packing gland type of seal may be employed between the telescoping elements. However, when gravity is employed to move the coupling elements into sealing engagement, it is important that the sealing means does not offer excessive resistance to vertical movement of the sleeve assemblies to minimize the likelihood of binding. This is particularly true in a hostile environment such as that encountered by a larry car where high temperatures and abrasive materials make the use of many conventional sealing materials impractical.

While the invention is illustrated and described in relation to larry car apparatus for charging coke ovens, it should be apparent that it is not so limited. Instead, the coupling mechanism of the invention may be employed to establish a substantially gas-tight connection between the downwardly-directed open end of various pipes, conduits, tubular conveyors and the like, and cylindrical openings in members positioned therebelow. For example, tubular conveyors or other filling pipes employed to charge bins, tanks, cars or the like may advantageously be equipped with a coupling means according to this invention. Such use may be particularly advantageous when handling fluent bulk solid material which contains substantial amounts of dust or fine solids which may tend to escape into the atmosphere during handling. Accordingly, while I have disclosed and described preferred embodiments of my invention, I wish it understood that I do not intend to be restricted solely thereto, but rather that I do intend to include all embodiments thereof which would be apparent to one skilled in the art and which come within the spirit and scope of my invention.

I claim:

1. Coupling means comprising, a generally vertically extending pipe having an open bottom end, a generally horizontal wall spaced below the open bottom end of the pipe, an opening in the generally horizontal wall, said opening having a circular top peripheral rim portion, seal means having an open center and including an annular upwardly directed substantially planar surface, and a downwardly and inwardly inclined substantially spherical annular sealing surface for engaging and making sealing contact with said top peripheral rim, elongated substantially cylindrical sleeve means for cooperating with said seal means to establish a closed communication path between said open bottom end of the generally vertically extending pipe and said opening in the generally horizontal wall, said sleeve having an open bottom end disposed in a plane extending at right angles to the longitudinal axis of the sleeve and adapted to engage the upwardly directed planar surface of the seal means around its full periphery to form a seal with said upwardly directed planar surface, mounting means supporting the sleeve means for coaxial telescoping movement along the pipe between a raised position spaced above the seal means and a lowered position in which its open bottom end projects below the open bottom end of the generally vertically extending pipe to engage and form a seal with said substantially planar surface on the seal means, said mounting means including power means operable to move the sleeve between the lowered and raised positions, and collapsible linkage means connected between the sleeve means and the seal means for supporting the seal means in suspended coaxial relation with and spaced beneath the open bottom end of the sleeve means and with the spherical sealing surface spaced above the generally horizontal wall when the sleeve means is in the raised position, the collapsible linkage means permitting limited lateral movement of the seal means relative to the sleeve means, the length of the collapsible linkage means and the extent of movement of the sleeve means between the raised and lowered positions being such that, when the sleeve means is moved from the raised to the lowered position, the spherical sealing surface engages said top peripheral rim portion of the opening in the generally horizontal wall before the sleeve means reaches the lowered position with the linkage means thereafter collapsing to permit further downward movement of the sleeve means to the lowered position in which the open bottom end of the sleeve means rests upon and forms a substantially gas-tight seal with the upwardly directed planar surface of the seal means around the full periphery of the sleeve means despite limited axial misalignment between the sleeve means and the seal means and despite limited displacement of said circular top peripheral rim portion from the horizontal.

2. The invention as defined in claim 1 wherein the seal means comprises an annular plate member normally supported in a substantially horizontal plane and having a top surface defining the upwardly directed planar surface, and a downwardly and inwardly extending ring rigidly mounted on the bottom surface of the plate, the spherical sealing surface being formed on said sealing ring.

3. The invention as defined in claim 1 wherein said collapsible linkage means comprises a plurality of flexible load-carrying members connected between the seal means and the sleeve means at spaced intervals around the periphery thereof.

4. The invention as defined in claim 3 wherein said flexible load-carrying members comprise lengths of chain.

5. The invention as defined in claim 1 wherein the sleeve means comprises an elongated conduit member mounted coaxially within the pipe for sliding movement between the raised and lowered positions.

6. The invention as defined in claim 5 wherein the elongated conduit means has an open bottom end projecting below the open bottom end of the pipe when the sleeve means is in the raised position, and wherein the open bottom end of the elongated conduit has a diameter greater than the inside diameter of the pipe.

7. The invention as defined in claim 5 wherein the generally vertically extending pipe has an inlet opening in the side wall thereof and wherein the elongated conduit member extends in overlying relation with the opening, the elongated conduit further comprising an opening in its side wall in registry with the opening in the side wall of the pipe when the sleeve means is in the lowered position and axially spaced from the opening in the pipe when the sleeve means is in the raised position.

8. The invention as defined in claim 1 wherein the sleeve means comprises inner and outer open-ended cylindrical sleeve members supported in concentric relation to one another, the outer diameter of the inner sleeve member being smaller than the inner diameter of the outer sleeve member to define an annular space therebetween, and wherein the sleeve means is mounted with the open bottom end of the pipe extending into the annular space between the inner and outer cylindrical sleeve members.

9. The invention as defined in claim 8 wherein the outer peripheral surface of the inner sleeve is spaced inwardly from the inner surface of the pipe to permit fluent particulate material flowing downwardly through the pipe to pass between the pipe and the inner cylindrical sleeve into the annular space between the inner and outer cylindrical sleeves.

10. The invention as defined in claim 9 wherein the sleeve means further comprises a plurality of circumferentially spaced radially extending spoke members extending between the inner and outer sleeve members at a position adjacent the bottom end of the inner sleeve member and rigidly joining the inner and outer sleeve members in fixed relation to one another with the open bottom end of the inner cylindrical sleeve member being spaced above the open bottom end of the outer cylindrical sleeve member.

11. The invention as defined in claim 8 wherein the seal means comprises an annular plate member normally supported in a substantially horizontal plane and having a top surface defining the upwardly directed planar surface and a bottom surface, and a downwardly and inwardly extending annular ring rigidly mounted on the bottom surface of the plate, the spherical sealing surface being formed on the annular ring.

12. The invention as defined in claim 11 further comprising an annular ring rigidly mounted on and projecting upwardly from the top surface of the annular plate member adjacent the outer periphery thereof, the annular ring having a diameter greater than the outside diameter of the outer sleeve member.

13. The invention as defined in claim 12 wherein said collapsible linkage means comprises a plurality of flexible load-carrying members connected between the seal means and the sleeve means at spaced intervals around the periphery thereof.

14. The invention as defined in claim 13 wherein said flexible load-carrying members comprise lengths of chain.

15. For use in charging the individual ovens of a battery of coke ovens through charging holes in the top of the ovens, the charging holes having circular top peripheral rim portions disposed in a generally horizontal plane, a larry car having wheels for engaging tracks extending along the top wall of the battery for movement into position above an oven to be charged, the larry car comprising, a plurality of hoppers mounted in position to be located one above each charging hole in an oven to be charged, each hopper having an annular coal discharge outlet in its bottom and a cylindrical charging pipe extending downwardly from its bottom in outwardly spaced concentric relation to the discharge opening and terminating in an open end spaced above the top wall of the ovens in position to be located in vertical alignment with the charging holes in the oven, and coupling means for forming a substantially gas-tight connection between the respective charging pipes and the top peripheral rim portion of a charging hole in an oven therebeneath, each coupling means including, elongated, substantially cylindrical sleeve means having an open bottom end disposed in a plane extending at right angles to the longitudinal axis of the sleeve, seal means having an open center, an upwardly directed substantially planar annular surface, and a downwardly directed substantially spherical annular sealing surface for engaging and forming a sealing contact with the top rim portion of an oven charging hole, means mounting the sleeve means in coaxial telescoping relation with a charging pipe for movement between a lowered position projecting below the open bottom end of the charging pipe and a raised position spaced above the seal means, power means for moving the sleeve means between the lowered and raised positions, and collapsible linkage means connected between the sleeve means and the seal means for supporting the seal means in suspended coaxial relation with and spaced beneath the sleeve means and with the spherical sealing surface spaced above the top wall of the ovens in the battery when the sleeve means is in the raised position, the collapsible linkage means permitting limited lateral movement of the seal means relative to the sleeve means, the length of the collapsible linkage means and the extent of movement of the sleeve means from the raised to the lowered position being such that when the sleeve means is moved to the lowered position, the spherical sealing surface engages and establishes a seal with the top rim portion of the charging hole in an oven therebeneath before the sleeve means reaches the lowered position with the linkage thereafter collapsing to permit further downward movement of the sleeve means to rest upon and form a substantially gas-tight seal with the upwardly directed planar surface on the seal means around the full periphery of the sleeve means despite limited axial misalignment between the sleeve means and the seal means and despite limited displacement of said circular top peripheral rim portion from the horizontal.

16. The invention as defined in claim 15 wherein said larry car further comprises a jumper pipe system including a vertically extending pipe member positioned to be located in substantially vertical alignment with a charging hole in an adjacent oven in the battery when the larry car is in position over an oven to be charged, conduit means connected between the vertical pipe section and an opening in the side wall of at least one of the charging pipes on said hoppers, said vertically extending pipe member terminating in an open end spaced above the top wall of the ovens in the battery, and movable coupling means for forming a substantially gas-tight connection between the open bottom end of the vertical pipe member and an oven charging hole positioned therebeneath.

17. The invention as defined in claim 15 wherein the sleeve means comprises inner and outer open-ended cylindrical sleeve members supported in concentric relation to one another, the other diameter of the inner sleeve member being smaller than the inner diameter of the outer sleeve member to define an annular space therebetween, and wherein the sleeve means is mounted with the open bottom end of the charging pipe extending into the annular space between the inner and outer cylindrical sleeve members.

18. The invention as defined in claim 17 wherein the outer peripheral surface of the inner sleeve member is spaced inwardly from the inner surface of the pipe to permit fluent particulate material flowing downwardly through the pipe to pass between the pipe and the inner cylindrical sleeve member into the annular space between the inner and outer cylindrical sleeve members.

19. The invention as defined in claim 18 wherein the sleeve means further comprises a plurality of circumferentially spaced radially extending spoke members extending between the inner and outer sleeve members at a position adjacent the bottom end of the inner sleeve member and rigidly joining the inner and outer sleeve members in fixed relation to one another with the open bottom end of the inner sleeve member being spaced above the open bottom end of the outer sleeve member.

20. The invention as defined in claim 17 wherein the annular upwardly directed planar surface of the seal means has an inside diameter substantially less than the diameter of the inner sleeve member and an outside diameter substantially greater than the diameter of the open bottom end of the outer sleeve member to permit limited axial misalignment between the annular seal means and the outer sleeve member when the sleeve means is in the lowered position, the outer sleeve member having its bottom end extending below the bottom end of the inner sleeve member to engage and be supported by the upwardly directed planar surface of the seal means when the sleeve means is in the lowered position.

21. The invention as defined in claim 20 wherein the seal means comprises an annular plate member normally supported in a substantially horizontal plane and having a top surface defining the upwardly directed planar surface and a bottom surface, and a downwardly and inwardly extending annular sealing ring rigidly mounted on the bottom surface of the plate, the spherical sealing surface being formed on the sealing ring.

22. The invention as defined in claim 21 further comprising an annular ring rigidly mounted on and projecting upwardly from the top surface of the annular plate member adjacent the outer periphery thereof, the annular ring having a diameter greater than the outside diameter of the outer sleeve member.

23. The invention as defined in claim 22 wherein said collapsible linkage means comprises a plurality of flexible load-carrying members connected between the seal means and the sleeve means at spaced intervals around the periphery thereof.

24. For use in charging the individual ovens of a battery of coke ovens through charging holes in the top wall of the ovens, the charging holes having circular, generally horizontally disposed peripheral rim portions, a larry car adapted to be supported on tracks extending along the top wall of the battery for movement into position above an oven to be charged, the larry car comprising, a plurality of hoppers mounted in position to be located one above each charging hole in an oven to be charged, each hopper having an annular coal discharge outlet in its bottom and a charging pipe extending downwardly from its bottom in outwardly spaced concentric relation to the discharge opening and terminating in an open bottom end spaced above the top wall of the ovens and in substantial vertical alignment with the associated discharge holes in an oven when the larry car is in position for charging the oven, a jumper pipe assembly including a vertically extending pipe member positioned to be located in substantially vertical alignment with a charging hole in an adjacent oven in the battery when the larry car is positioned over an oven to be charged and conduit means connected between the vertically extending pipe member and an opening in the side wall of at least one of the charging pipes extending downwardly from said hoppers, coupling means associated with each charging pipe and with the vertically extending pipe of the jumper pipe system for forming a substantially gas-tight connection between each such pipe and the top rim portion of a charging hole in an oven therebeneath, each coupling means including, elongated substantially cylindrical sleeve means having an open bottom end disposed in a plane extending at substantially right angles to the longitudinal axis of the sleeve, means mounting the sleeve means in coaxial telescoping relation with the associated pipe for movement between a lowered position projecting below the open bottom end of the pipe and a raised position, power means for moving the sleeve means between the lowered and raised positions, seal means having an open center, and including an annular sealing plate member having an upwardly directed substantially planar annular surface, and a downwardly directed annular substantially spherical sealing surface for engaging and making sealing contact with the top rim portion of an oven charging hole, and collapsible linkage means connected between the sleeve means and the seal means for supporting the sealing member in suspended coaxial relation with and spaced beneath the sleeve means and with the spherical sealing surface spaced above the top wall of the ovens in the battery when the sleeve means is in the raised position, the collapsible linkage means permitting limited lateral movement of the seal means relative to the sleeve means, the length of the collapsible linkage means and the extent of movement of the sleeve means from the raised to the lowered position being such that when the sleeve means is moved to the lowered position the spherical sealing surface engages and establishes a seal with the top rim portion of the charging hole therebeneath before the sleeve means reaches the lowered position with the linkage thereafter collapsing to permit further downward movement of the sleeve means to the lowered position to rest upon and form a substantially gas-tight seal with the upwardly directed planar surface on the seal means around the full periphery of the sleeve means despite limited axial misalignment between the sleeve means and the seal means and despite limited displacement of said circular top peripheral rim portion from the horizontal.

25. The invention as defined in claim 24 wherein the seal means comprises an annular plate member normally supported in a substantially horizontal plane and having a top surface defining the upwardly directed planar surface and a downwardly and inwardly extending ring rigidly mounted on the bottom surface of the plate, the spherical sealing surface being formed on said sealing ring.

26. The invention as defined in claim 24 wherein said collapsible linkage means comprises a plurality of flexible load-carrying members connected between the seal means and the sleeve means at spaced intervals around the periphery thereof.

27. The invention as defined in claim 26 wherein said flexible load-carrying members comprise lengths of chain.

28. The invention as defined in claim 24 wherein the coupling means associated with the vertically extending pipe of the jumper pipe system includes sleeve means in the form of an elongated conduit member mounted coaxially within the vertically extending pipe for sliding movement between the raised and lowered positions.

29. The invention as defined in claim 28 wherein the elongated conduit means has an open bottom end projecting below the open bottom end of the vertically extending pipe when the sleeve means is in the raised position, and wherein the open bottom end of the elongated conduit has a diameter greater than the inside diameter of the vertically extending pipe.

30. The invention as defined in claim 28 wherein the vertically extending pipe has an inlet opening in the side wall thereof and wherein the elongated conduit member extends in overlying relation with the opening, the elongated conduit further comprising an opening in its side wall in registry with the opening in the side wall of the vertically extending pipe when the sleeve means is in the lowered position and axially spaced from the opening in the vertically extending pipe when the sleeve means is in the raised position.

31. The invention as defined in claim 24 wherein the coupling means associated with each charging pipe includes a sleeve means in the form of inner and outer open-ended cylindrical sleeve members supported in concentric relation to one another, the outer diameter of the inner sleeve member being smaller than the inner diameter of the outer sleeve member to define an annular space therebetween, and wherein the sleeve means is mounted with the open bottom end of the charging pipe extending into the annular space between the inner and outer cylindrical sleeve members.

32. The invention as defined in claim 31 wherein the outer peripheral surface of the inner sleeve is spaced inwardly from the inner surface of the charging pipe to permit fluent particulate material flowing downwardly through the charging pipe to pass between the charging pipe and the inner cylindrical sleeve into the annular space between the inner and outer cylindrical sleeves.

33. The invention as defined in claim 32 wherein the sleeve means further comprises a plurality of circumferentially spaced radially extending spoke members extending between the inner and outer sleeve members at a position adjacent the bottom end of the inner sleeve member and rigidly joining the inner and outer sleeve members in fixed relation to one another with the open bottom end of the inner cylindrical sleeve member being spaced above the open bottom end of the outer cylindrical sleeve member.

34. The invention as defined in claim 31 wherein the annular upwardly directed planar surface of the seal means has an inside diameter substantially less than the diameter of the inner sleeve member and an outside diameter substantially greater than the diameter of the open bottom end of the outer sleeve member to permit limited axial misalignment between the annular seal means and the outer sleeve member when the sleeve means is in the lowered position, the outer sleeve member having its bottom end extending below the bottom end of the inner sleeve member to engage and be supported by the upwardly directed planar surface of the seal means when the sleeve means is in the lowered position.

35. The invention as defined in claim 34 wherein the seal means comprises an annular plate member normally supported in a substantially horizontal plane and having a top surface defining the upwardly directed planar surface and a bottom surface, and a downwardly and inwardly extending annular ring rigidly mounted on the bottom surface of the plate, the spherical sealing surface being formed on the annular ring.

36. The invention as defined in claim 35 further comprising an annular ring rigidly mounted on and projecting upwardly from the top surface of the annular plate member adjacent the outer periphery thereof, the annular ring having a diameter greater than the outside diameter of the outer sleeve member.

* * * * *